US005328325A

United States Patent [19]

Strohl et al.

[11] Patent Number: 5,328,325

[45] Date of Patent: Jul. 12, 1994

[54] PERIPHERAL PUMP, PARTICULARLY FOR DELIVERING FUEL FROM A STORAGE TANK TO THE INTERNAL COMBUSTION ENGINE OF A MOTOR VEHICLE

[75] Inventors: Willi Strohl, Beilstein, Fed. Rep. of Germany; Loren Smith, Westland; Jaihind-Singh Sumal, Bloomfield, both of Mich.

[73] Assignee: Robert Bosch GmbH, Stuttgart, Fed. Rep. of Germany

[21] Appl. No.: 966,034

[22] PCT Filed: May 27, 1991

[86] PCT No.: PCT/DE91/00443

§ 371 Date: Dec. 24, 1992

§ 102(e) Date: Dec. 24, 1992

[87] PCT Pub. No.: WO92/00457

PCT Pub. Date: Jan. 9, 1992

[30] Foreign Application Priority Data

Jun. 28, 1990 [DE] Fed. Rep. of Germany ..... 4020521

[51] Int. Cl.[5] ..... F04D 5/00

[52] U.S. Cl. ..... 415/55.1; 415/55.2

[58] Field of Search ..... 415/55.1, 55.2, 55.3, 415/55.5

[56] References Cited

U.S. PATENT DOCUMENTS

| | | | |
|---|---|---|---|
| 1,973,669 | 9/1934 | Spoor | 415/55.1 |
| 3,871,797 | 3/1975 | Igarashi et al. | 415/55.1 |
| 4,462,761 | 7/1984 | Ringwald | 415/55.1 |

FOREIGN PATENT DOCUMENTS

| | | | |
|---|---|---|---|
| 2104495 | 7/1972 | Fed. Rep. of Germany | 415/55.1 |
| 3130286 | 2/1983 | Fed. Rep. of Germany . | |
| 954916 | 2/1950 | France . | |
| 62996 | 4/1982 | Japan | 415/55.1 |
| 10193 | 1/1983 | Japan | 415/55.1 |
| 271992 | 11/1987 | Japan | 415/55.2 |

*Primary Examiner*—Edward K. Look
*Assistant Examiner*—Michael S. Lee
*Attorney, Agent, or Firm*—Michael J. Striker

[57] ABSTRACT

The peripheral pump includes a wall bounding a pump chamber and provided with a substantially annular delivery port with a base having a circular segment with a center; a circular cylindrical impeller revolving in the pump chamber, having two end faces and a rim of blades disposed at intervals along a circumference of the impeller so that a groove-like gap is formed between two adjacent blades, the groove-like gap having a base, as seen in a longitudinal section through the pump, having a circular segment with a center substantially coincident with the center of the circular segment of the delivery port, the center of the circular segments being located within an outer contour of the impeller.

9 Claims, 1 Drawing Sheet

PERIPHERAL PUMP, PARTICULARLY FOR DELIVERING FUEL FROM A STORAGE TANK TO THE INTERNAL COMBUSTION ENGINE OF A MOTOR VEHICLE

BACKGROUND OF THE INVENTION

The present invention relates to a peripheral pump. More particularly it relates to a pump for delivering fuel from a storage tank to the internal combustion engine of a motor vehicle.

In particular it relates to a peripheral pump of the above mentioned general type which has a circular-cylindrical impeller revolving in a pump chamber and provided at least on one of its two end faces with a rim of blades disposed at intervals along the circumference of the impeller. Such a pump in which the common center of the two partial circles lies on the axial gap between the impeller and the chamber wall is already known (U.S. Pat. No. 3,315,607). But the efficiency of such peripheral pumps may not be satisfactory.

SUMMARY OF THE INVENTION

Accordingly, it is an object of the present invention to provide a peripheral pump of the above mentioned general type , which avoids the disadvantages of the prior art.

According to the invention, the peripheral pump includes a wall bounding a pump chamber and provided with a substantially annular delivery port with a base having a circular segment with a center; a circular cylindrical impeller revolving in the pump chamber, having two end faces and a rim of blades disposed at intervals along a circumference of the impeller so that a groove-like gap is formed between two adjacent blades, the groove-like gap with a base, as seen in a longitudinal section through the pump, having a circular segment with a center substantially coincident with the center of the circular segment of the delivery port, the center of the circular segments being located within an outer contour of the impeller.

When the peripheral pump is designed in accordance with the present invention, it has the advantage over the prior art that the pump output is increased to a satisfactory degree because the circulating stream Qc can be increased by approximately 20%, other conditions remaining the same. Accordingly, the maximum delivery pressure can be correspondingly increased while maintaining the same external dimensions and operating conditions.

The novel features which are considered as characteristic for the invention are set forth in particular in the appended claims. The invention itself, however, both as to its construction and its method for operation, together with additional objects and advantages thereof, will be best understood from the following description of specific embodiments when read in connection with the accompanying drawings.

DESCRIPTION OF THE PREFERRED EMBODIMENT EXAMPLE

Figure 1:
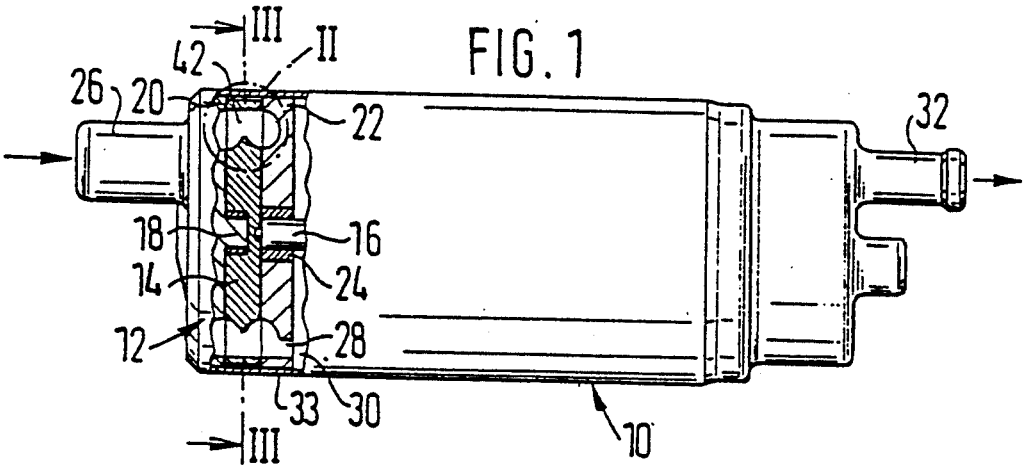
FIG. 1 is a partially side, partially longitudinal cross-sectional view of a peripheral pump according to the invention.

A unit 10 shown in FIG. 1 serves to deliver fuel from a storage tank, not shown, to the internal combustion engine, likewise not shown, of a motor vehicle. The fuel delivery unit 10 has a stream pump 12 whose impeller 14 is connected to a shaft 16 so as to be fixed with respect to rotation relative to it, the shaft 16 being driven by an electric drive motor, not shown. The impeller 14 fits on a bearing pin 18 and is arranged in a so-called pump chamber 19 which is defined at both sides—as seen in the axial direction of the impeller 14—by walls 20 and 22. The bearing pin 18 is arranged at the wall 20. The wall 22 has a bearing 24 for the drive shaft 16. During operation of the delivery unit 10 the stream pump 12 sucks fuel through a suction neck 26 and presses this medium, via a pump outlet 28 in the wall 22, into a space 30 in which the electric motor, not shown, is accommodated. From this space 30, the fuel is fed via an output or discharge neck 32 to the internal combustion engine. Since both the stream pump 12 and the electric motor, not shown, are accommodated in a common housing 33 which is provided with a suction neck 26 and a discharge neck 32 and the fuel accordingly flows through the fuel delivery unit 10, the fuel delivery unit forms, as it were, a part of the delivery line from the storage tank to the internal combustion engine.

Figure 2:
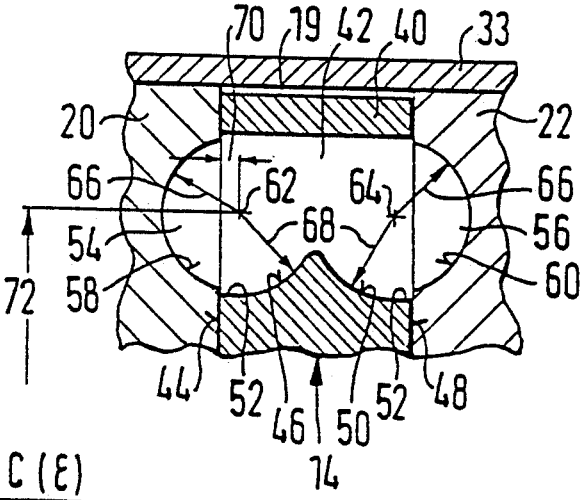
FIG. 2 is a cutaway detailed longitudinal cross-sectional view of a portion of the peripheral pump shown in FIG. 1.
Figure 3:
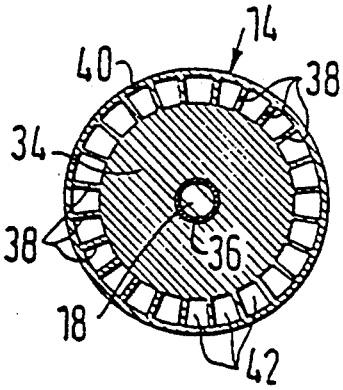
FIG. 3 is a transverse cross-sectional view through the peripheral pump shown in FIG. 1 taken along the line III—III in FIG. 1.

As can be seen from FIG. 3, the impeller 14 of the stream pump 12 has a disk-shaped central region 34 which is provided with a central bearing bushing 36 in which the bearing pin 18 of the wall 20 is supported. The impeller 14, or its central region 34, has a plurality of radial blades 38 which are connected with one another at their ends remote of the central region 34 by a circumferentially extending ring 40, but this ring 40 is an optional element in this embodiment. The blades 38 are formed by cross-pieces remaining between openings 42 of the impeller 14 which are arranged on a common partial circle. The cross-pieces define the openings 42 in the circumferential direction. The axis of each opening 42 extends parallel to the axis of rotation of the impeller. Since the outer ring 40 is optional, the gap 42 remaining between the blades 38 adjacent to one another in the circumferential direction can also be designated as a groove. As shown particularly by FIG. 2, the base of the groove is formed in a particular manner. The groove base 46 extends along a partial circle proceeding from one end face 44 of the impeller 14. The same is true of the other side of the impeller 14 where the groove base 50 likewise extends along a partial circle proceeding from the end face 48. The two circular segments 46 and 50 pass smoothly one into the other in the center region of the impeller 14. Since the impeller 14 is preferably produced in a mold, both the groove base 46 and the groove base 50 must lead to the end faces 44 and 48 extending parallel to the axis of rotation of the impeller along short horizontal end portions 52 to facilitate manufacture. An almost annular delivery port 54 and 56 is arranged in the two chamber walls 20 and 22. The base 58 of the delivery port 54 as well as the base 60 of the delivery port 56 are likewise shaped like a circular segment. Circular segments 46 and 58 as well as circular segments 50 and 60 have common centers 62 and 64, respectively. The radii of each groove base 46 and 50 are designated by 68 in FIG. 2. The radii of each base 58, 60 of the delivery ports 54 and 56 are designated by 66 in FIG. 2. A substantial feature of the invention consists in that the centers 62 and 64, respectively, of the two circular segments 68 and 66 are identical and lie within the contour of the impeller 14 (FIG. 2). As is also shown in FIG. 2, the two centers 62 and 64 have been moved into the impeller contour by an amount 70 as measured from the respective adjacent end faces 44 and 48 of the impeller 14. Further, it is noteworthy that the two centers 62 and 64—with reference to the axis of rotation of the impeller—are arranged on a common partial circle with a radius 72.

The pressure of a peripheral pump can be calculated in an approximate manner according to relevant technical literature by the following formula:

$$p = : \frac{\rho}{A} \times Qc \times \left(\omega R - \frac{Qt}{A}\right) \quad (1)$$

where p=pressure;

$\rho$=density;

A=delivery port cross section;

$\omega$=angular speed of the impeller;

R=radius of impeller;

Qt=quantity pumped, including internal leakage;

Qc=circulating stream (quantity of liquid moved per second between port and impeller).

Qc can be calculated approximately by the formula $$Qc = C\sqrt{\omega^2 R - \frac{Q^2}{A2 \cdot R}}$$

where C is a constant which is only dependent on the pump geometry.

For the pump to achieve the highest possible delivery pressure, all other operating conditions remaining the same, it is important that this C factor be as high as possible.

Figure 4:
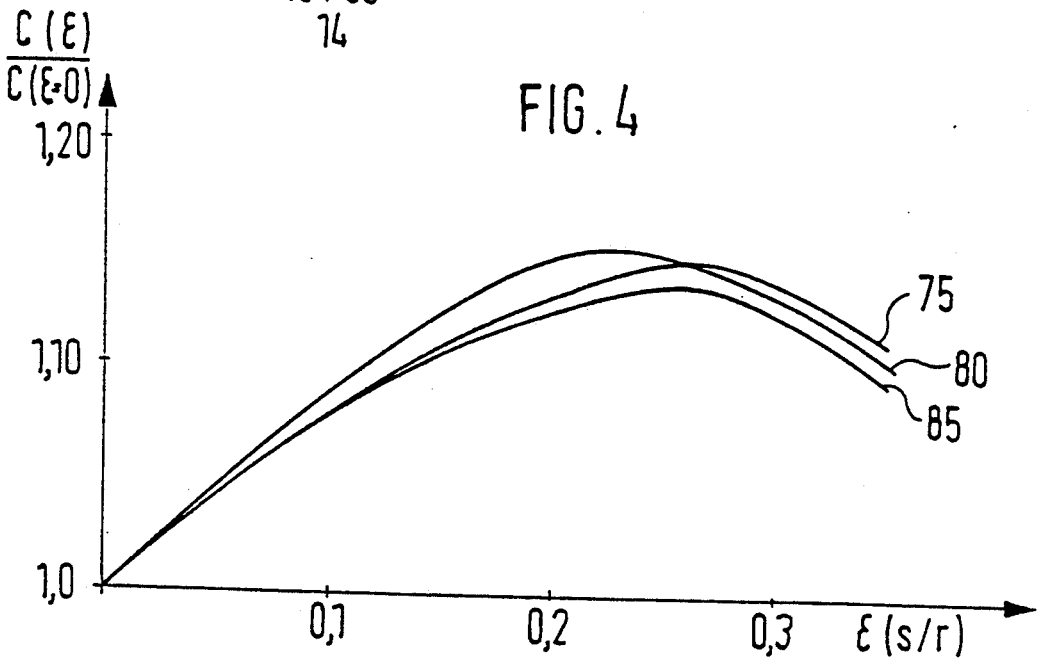
FIG. 4 is a graphical illustration showing the increase factor for the circulating stream flow as a function of s/r, where s is the distance of the center of a circular arc segment of the port wall surface from the wall in which the port is formed and r is the port radius.

Qc or C can be derived from measurements. Without measurements, i.e. when there is no pump, Qc or C can only be calculated in an approximate manner with finite elements from the geometry and the operating data. In such calculations it has been found that when all of the parameters included in equations (1) and (2) remain constant the constant C has a maximum value when the pump geometry has the following features:

1. Port cross section is a circle segment,
2. The center of the circle segment coincident with the port cross-section surface is situated within the impeller at a distance $s=\epsilon \times r$ from the edge of the impeller, where the value for $\epsilon$ should lie between 0.15 and 0.35, preferably between 0.2 and 0.3, r is the port radius in cross section (measurement 66) and s is the distance of the center for r from the edge of the impeller (measurement 70) (end face). In the graphical illustration according to FIG. 4, the value $\epsilon$ is plotted on the abscissa and the ratio of the respective C factor C ($\epsilon$) to the C factor for $\epsilon=0$; C($\epsilon=0$), i.e.

$$\frac{C(\epsilon)}{C(\epsilon = 0)}$$

is plotted on the ordinate. For the curve 75, 17.5 mm is assumed for R and 4.52 mm$^2$ is assumed for A. In curve 80, the value of 17.5 mm for R is maintained and A is increased to 5.31 mm$^2$. The curve 85 is based on the values R=14.2 and A=4.52 mm$^2$.

Accordingly, the position of the maximum for C ($\epsilon$)/C (0) still lies between approximately 0.2 and 0.7, preferably approximately $\epsilon=0.25$, virtually regardless of the absolute values for A and R.

It will be understood that each of the elements described above, or two or more together, may also find a useful application in other types of constructions differing from the types described above.

While the invention has been illustrated and described as embodied in a peripheral pump, particularly for delivering fuel from a storage tank to the internal combustion engine of a motor vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A peripheral pump comprising a wall bounding a pump chamber and provided with a substantially annular delivery port with a base having a circular segment with a center; a circular cylindrical impeller revolving in said pump chamber and having two end faces with at least one of said end faces provided with rim of blades disposed at intervals along a circumference of the impeller so that a groove-like gap is formed between two adjacent blades, said groove-like gap having a base, as seen in a longitudinal section through the pump, having a circular segment with a center substantially coincident with said center of said circular segment of said delivery port, said center of said circular segments being located within a contour of said impeller.

2. A peripheral pump as defined in claim 1, wherein said base of said gap between two adjacent blades has a radius which substantially corresponds to a radius of said base of said delivery port.

3. A peripheral pump as defined in claim 1, wherein said base of said gap between two adjacent blades has a radius which is greater than a radius of said base of said delivery port.

4. A peripheral pump as defined in claim 1, wherein a distance measured from an end face which intersects an axis of rotation of said impeller to said center is r times $\epsilon$, where r is a radius of said base of said delivery port, $\epsilon$ is a constant between 0.15 and 0.35.

5. A peripheral pump as defined in claim 4, wherein the constant $\epsilon$ is equal to between 0.2 and 0.3.

6. A peripheral pump as defined in claim 1, wherein said circular segment of said base of said gap between two adjacent blades is concentric to said circular segment of said delivery port.

7. A peripheral pump as defined in claim 1, further comprising another wall bounding said pump chamber on a side of said impeller remote from said end face provided with said rim of blades and wherein the other of said end faces of said impeller is provided with another of said at least one rim of blades, said other wall having another annular delivery port, each of said annular delivery ports adjoining a respective one of said rim of blades.

8. A peripheral pump as defined in claim 1, wherein said impeller has a central region and said blades have ends remote from said central region; and further comprising means for connecting said ends of said blades remote from said central region with one another.

9. A peripheral pump as defined in claim 8, wherein said connecting means include a circumferentially extending ring which connects said ends of said blades with one another.

* * * * *